US012178324B2

(12) United States Patent
Sander et al.

(10) Patent No.: US 12,178,324 B2
(45) Date of Patent: Dec. 31, 2024

(54) SYNCHRONOUS MECHANISM FOR A PIECE OF SEATING FURNITURE, AND PIECE OF SEATING FURNITURE

(71) Applicant: COMFORDY CO., LTD., Tainan (TW)

(72) Inventors: Armin Sander, Fürth (DE); Martin Potrykus, Bamberg (DE)

(73) Assignee: Comfordy Co., Ltd., Tainan (TW)

( * ) Notice: Subject to any disclaimer, the term of this patent is extended or adjusted under 35 U.S.C. 154(b) by 0 days.

(21) Appl. No.: 17/309,257

(22) PCT Filed: Nov. 18, 2019

(86) PCT No.: PCT/EP2019/081655
§ 371 (c)(1),
(2) Date: May 12, 2021

(87) PCT Pub. No.: WO2020/104376
PCT Pub. Date: May 28, 2020

(65) Prior Publication Data

US 2024/0381999 A1 Nov. 21, 2024

(30) Foreign Application Priority Data

Nov. 20, 2018 (DE) ..... 10 2018 219 885.3

(51) Int. Cl.
*A47C 1/032* (2006.01)

(52) U.S. Cl.
CPC ..... *A47C 1/03277* (2013.01); *A47C 1/03255* (2013.01)

(58) Field of Classification Search
CPC ..... A47C 1/03277
See application file for complete search history.

(56) References Cited

U.S. PATENT DOCUMENTS 4,747,640 A * 5/1988 Locher ..... A47C 1/03283 297/300.3 X
4,889,385 A * 12/1989 Chadwick ..... A47C 7/441 297/285

(Continued)

FOREIGN PATENT DOCUMENTS

AT 504897 A4 * 9/2008 ..... A47C 1/03255
CH 702970 A2 * 10/2011 ..... A47C 1/03255

(Continued)

*Primary Examiner* — Rodney B White
(74) *Attorney, Agent, or Firm* — Rosenberg, Klein & Lee

(57) ABSTRACT

A synchronous mechanism for a seating furniture is provided having a seat surface support, a bending element whose length in the sagittal direction extends over a large part of a seat depth of the seat surface support and is coupled to the seat surface support for movement relative thereto. The synchronous mechanism has a backrest support mounted movably relative to the bending element for holding a backrest. The backrest support merges at the end into a pivot lever, coupled to the bending element at a pivot point to be pivotable about an axis of rotation transverse to the sagittal plane, a lever section of the pivot lever is in contact with the seat surface support at a bearing point, and, in the unloaded state of the seating furniture, the pivot point lies higher than the bearing point, as seen in the vertical direction.

14 Claims, 5 Drawing Sheets

(56) References Cited

U.S. PATENT DOCUMENTS

Figure 1:
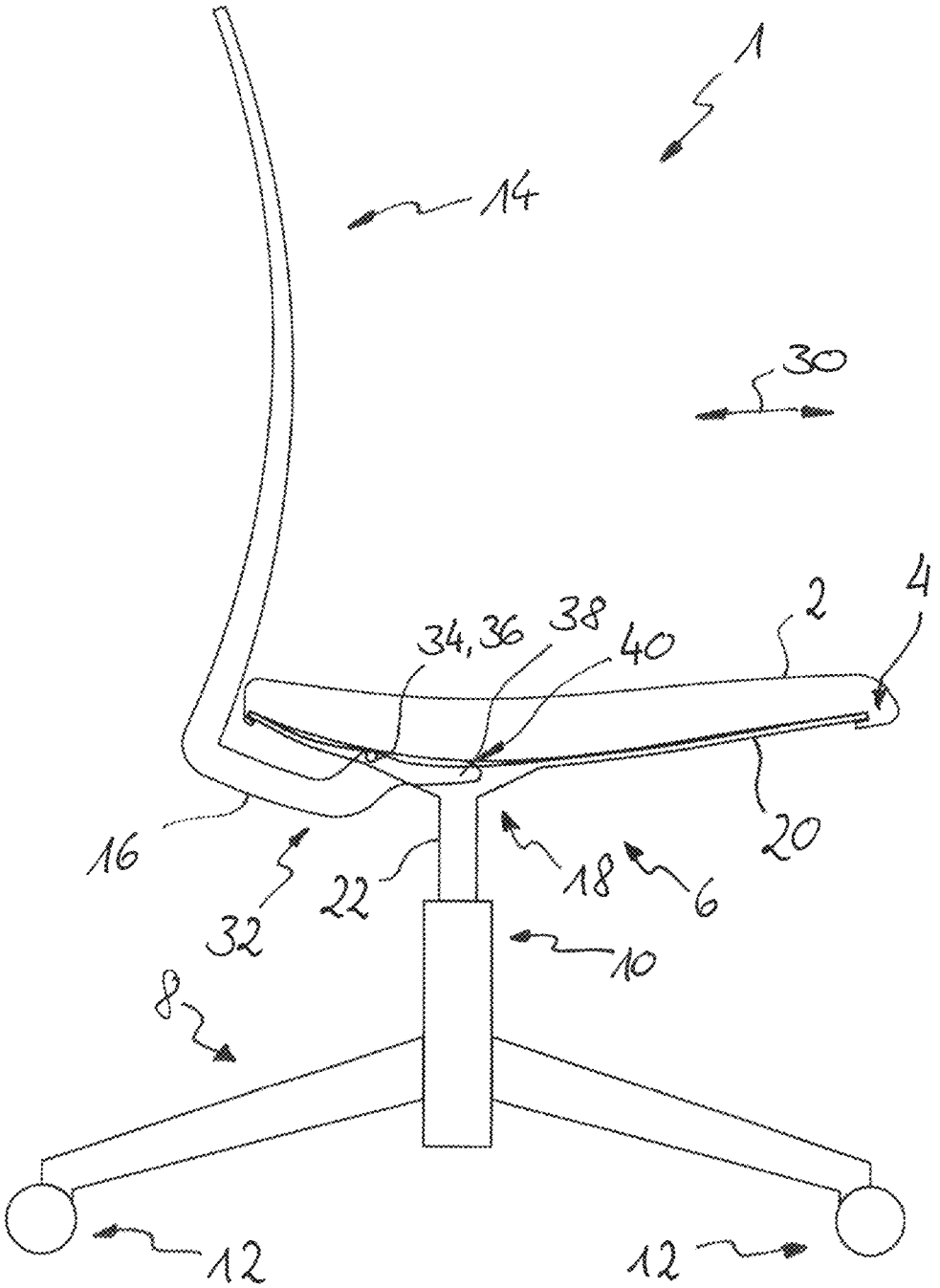

| | | | | | |
|---|---|---|---|---|---|
| 4,911,501 | A * | 3/1990 | Decker | A47C 3/0252 | 297/300.1 X |
| 5,046,780 | A * | 9/1991 | Decker | A47C 1/03255 | 297/300.1 |
| 5,121,934 | A * | 6/1992 | Decker | A47C 3/0252 | 297/300.1 |
| 5,775,774 | A * | 7/1998 | Okano | A47C 1/03255 | 297/300.2 X |
| 9,713,381 | B2 * | 7/2017 | Davis | A47C 1/03255 | |
| 9,883,746 | B2 * | 2/2018 | Piretti | A47C 1/03294 | |
| 10,016,061 | B2 * | 7/2018 | Brueske | A47C 7/462 | |
| 10,206,513 | B2 * | 2/2019 | Brueske | A47C 7/006 | |
| 10,780,003 | B2 * | 9/2020 | Beyer | A61G 5/122 | |
| 10,820,703 | B2 * | 11/2020 | Maier | A47C 1/03277 | |
| 11,134,780 | B2 * | 10/2021 | Maier | A47C 7/44 | |
| 11,197,548 | B2 * | 12/2021 | Theesfeld | A47C 1/03255 | |
| 11,344,122 | B2 * | 5/2022 | Serena | A47C 7/285 | |
| 11,471,345 | B2 * | 10/2022 | Beyer | A47C 9/005 | |
| 11,553,797 | B2 * | 1/2023 | Ludwig | A47C 7/445 | |
| 11,812,870 | B2 * | 11/2023 | Deevers | A47C 1/03277 | |
| 2002/0109384 | A1 * | 8/2002 | Hansen | A47C 1/03255 | 297/300.1 |
| 2013/0169017 | A1 * | 7/2013 | Masunaga | A47C 1/03255 | 297/320 |
| 2016/0128481 | A1 * | 5/2016 | Piretti | A47C 1/03255 | 297/300.1 |
| 2024/0138573 | A1 * | 5/2024 | Deevers | A47C 7/4454 | |

FOREIGN PATENT DOCUMENTS

| | | | | |
|---|---|---|---|---|
| EP | 1358821 | A1 * | 11/2003 | A47C 1/03238 |
| EP | 1989963 | A1 * | 11/2008 | A47C 1/03255 |
| EP | 2888975 | A1 * | 7/2015 | A47C 1/03255 |
| WO | WO-2008000295 | A1 * | 1/2008 | A47C 1/03255 |

* cited by examiner

SYNCHRONOUS MECHANISM FOR A PIECE OF SEATING FURNITURE, AND PIECE OF SEATING FURNITURE

The invention relates to a synchronous mechanism for a seating furniture, which has a seating part and a movable backrest. Furthermore, the invention relates to such a seating furniture. Seating furniture is understood to mean in particular a chair, for example an office chair, conference chair or the like.

Depending on the field of application, seating furniture is usually constructed from various aspects. Typical seating furniture, in particular chairs for use at dining tables, is often comparatively stiff (i.e. hardly springy and/or with an upright, in particular non-adjustable, backrest). Seating furniture for sitting in a relaxed atmosphere, for watching television, reading or the like, (often also referred to as "lounge furniture"), on the other hand, frequently has a comparatively low-lying seat and an inclined backrest. As a rule, this seating furniture also has a comparatively high degree of springiness.

Seating furniture for everyday office use, in particular office chairs, specifically office swivel chairs, are designed as far as possible for long and unstrained sitting, but also for an upright posture. In most cases, such office chairs have a so-called synchronous mechanism which, by means of coupling the backrest with the seat surface (the "seating part"), causes the seating part to also move when the backrest is loaded and thus tilted backwards, for example by raising the front edge of the seating part and/or lowering the rear edge, but usually by a slightly smaller angle than the backward tilt of the backrest. The synchronous mechanism is usually adjustable by means of an adjusting means in such a way that the resistance, which the backrest offers to a backward inclination and thus a restoring force can be adjusted individually, in particular as a function of the weight of the person using the seating furniture.

Various mechanisms and methods are possible for adjustment. For example, the preload of a spring exerting the restoring force can be adjusted manually via an actuating element such as a handwheel. In order to be able to adjust the spring preload, however, a very high force is required, so that a complex transmission is usually necessary, which also means that a comparatively large number of revolutions have to be performed in order to achieve a noticeable adjustment.

Alternatively, it is possible to design an entire spring assembly arrangement or the spring element arrangement in general so that it can be pivoted, so that the pivot points of the spring element in the parallelogram of forces are changed. However, this requires a relatively large installation space, since the entire spring element has to be pivoted.

However, the known adjustment mechanisms have a comparatively large installation space, so that the vertical distance between an upper end of a support column and a seat support is comparatively large.

The invention is based on the task of enabling a seat with a simplified and visually unobtrusive synchronous mechanism This task is solved according to the invention by a synchronous mechanism with the features of claim 1. Furthermore, this task is solved according to the invention by a seating furniture with the features of claim 13. Advantageous and partly individually inventive embodiments and further developments of the invention are set out in more detail in the dependent claims and in the following description.

The synchronous mechanism according to the invention is designed for use on seating furniture, in particular on a chair, preferably on an office swivel chair. The synchronous mechanism has a seat surface support, which is designed to hold a seat surface (which in particular comprises a seat cushion or the like) and thus supports the seat surface in the intended final assembled state of the seating furniture. In addition, the synchronous mechanism has a bending element whose length, viewed in the sagittal direction, extends over a large part (i.e. preferably more than 50%, in particular more than 75%) of a seat depth of the seat surface support. The bending element is movably coupled to (i.e. relative to) the seat surface support. Preferably, the bending element can be deflected relative to the seat surface support, in particular elastically, as viewed in the height direction, under the action of a spring force. The synchronous mechanism also has a backrest support, which is mounted movably relative to the bending element and is used to hold a backrest. The backrest support merges at the end (i.e. in particular facing away from the backrest in the intended final assembled state) into a pivot lever. This pivot lever is in turn coupled to the bending element at a fixed pivot point (relative to the bending element, i.e. arranged fixedly thereon) so as to be pivotable about an axis of rotation transverse to the sagittal plane. A lever section of the swivel lever is in contact with the seat surface support at a bearing point. In the unloaded state of the seating furniture, the pivot point is higher than the bearing point when viewed in the height direction. In the loaded state, the bearing point in particular is displaced relative to the pivot point, at least in the height direction, so that the bending element is braced against the seat surface support.

Preferably, the pivot lever is coupled to the bending element at the pivot point by means of a pivot bearing, preferably a sleeve, which engages around the pivot axis.

Preferably, the pivot lever is cranked, i.e. designed at least angled once. Further preferably, in particular, the lever section in the region of the pivot point or the bearing point is angled relative to the rest of the backrest support.

The term "sagittal direction" or "sagittal plane" here and in the following is understood to mean the direction or plane of the seating furniture or synchronous mechanism that corresponds to the sagittal direction or sagittal plane of a user of the seating furniture in an intended sitting position.

Preferably, the bending element is arranged at least approximately (i.e. exactly or with minor deviations of up to 10 degrees) parallel to the seat surface support in the unloaded state.

Further preferably, the bending element is coupled to the seat surface support at least with its front end (facing away from the backrest) and its rear end (facing the backrest).

Preferably, the bending element forms a bending spring and is hereinafter also referred to as such. Optionally, the bending spring is designed in several parts, for example divided in the sagittal direction and/or transversely thereto. That means that the bending spring optionally has several individual elements, for example several spring sections or spring arms, which are combined with one another to form a common component (in particular the seat support).

As the pivot point is higher than the bearing point in the unloaded state (also referred to as the resting position), the bearing point or respectively the corresponding lever section of the backrest support moves practically (i.e. at least approximately) in a straight line upwards when the backrest is pivoted—at least within a permissible backward inclination range. As a result, in the intended state of use, the seat surface is raised at least approximately parallel or optionally with a slight inclination towards the rear. If the pivot point was lower than the bearing point, the result would be an at least tangential to the pivot point and in its direction directed force and motion vector, optionally also a circular arc-shaped lifting path, which is composed of a component straight upwards and a component approximately horizontal to the rear.

In addition, due to the use of the pivot lever, which is arranged between the seat surface support and the bending spring for the transmission of force, a comparatively complex mechanism, for example a gearbox, can be omitted. In particular, the use of the pivot lever and the bending spring is comparatively inexpensive. Thus, advantageously, a box-like housing, in which such a mechanism is installed can be omitted below the seat support. This contributes to a "slim", unobtrusive design of the synchronous mechanism. In particular, the bending spring also serves to guide and/or support the movement of the seat surface when the backrest is tilted backwards. In this way, the synchronous mechanism described above also forms an automatic weight mechanism, in which the own body weight of the person sitting on the seat surface is lifted, in particular indirectly via the backward inclination of the backrest, and thus advantageously a manual adjustment of the synchronous mechanism to the body weight of the person sitting on the seating furniture can be omitted.

In an appropriate embodiment, the bending spring also has a receptacle for a frame of the seating furniture. In this case, the bending spring preferably forms a type of seat support that couples the frame to the seat surface support in the intended final assembled state of the seating furniture. This contributes to the slim design of the synchronous mechanism, since the bending spring is integrated with the receptacle for the frame.

In a preferred embodiment of the invention, the bearing point in the unloaded state is arranged such that a motion vector (or force vector)—I.e., the tangent line relative to the pivot point-is oriented parallel to the vertical or inclined at an acute angle (e.g., of less than 20, 15 or 10 degrees) away from the vertical and the pivot point. For this purpose, the bearing point is preferably offset from the pivot point along the sagittal direction. This design contributes to the at least approximately rectilinear upward movement of the bearing point. A displacement of the bearing point in the sagittal direction relative to the pivot point is in this case comparatively small, in particular negligible, or non-existent. A significant friction-induced damage to the contact surfaces between the lever section and the seat surface support can thus be avoided. In particular, the bearing point is offset in the direction of a front side or front edge of the seat surface.

In a further preferred embodiment, the bending spring is divided (at least mentally) by the pivot point and/or the bearing point into a short spring arm facing the rear side of the seat surface support and a long spring arm extended in comparison thereto and facing the front side of the seat surface support. This means that the pivot point and/or the bearing point are arranged in a "rear" half of the bending spring (viewed in the sagittal direction). Preferably, in each case the pivot point is arranged in the rear half. Optionally, the bearing point is also arranged in the rear half of the bending spring, in particular also in the rear half of the seat surface support. As a result-at least if the spring stiffness of the bending spring is preferably uniform-the rear spring arm has a comparatively higher spring stiffness, as a result of which the front edge (i.e. the edge opposite the backrest) of the seat surface support is raised further relative to the rear edge when the backrest is deflected backwards. Optionally, the two spring arms of the bending spring are manufactured separately and connected to one another. Appropriately, however, the two spring arms are formed integrally, in particular one-piece integrally (also: monolithically) with each another.

In addition or alternatively, in one variant of the invention, the front spring arm is designed in a different way with a different spring stiffness than the rear spring arm, for example by selecting a different material thickness between the two spring arms, one of the spring arms having reinforcing ribs or beads, or the like. In this case, the two spring arms are optionally also selected to be of equal length.

Preferably, the bearing point is also positioned in such a way that, in the unloaded (in particular undeflected) state of the backrest, it is arranged approximately (i.e. possibly with slight deviations of approximately 5 cm)—when sitting on the seat surface as intended—below the ischial tuberosity and/or the hip joint. This represents an anatomically favorable position for the application of force when moving the seat surface.

In a particularly appropriate embodiment of the invention, the bending spring is designed as a leaf spring, preferably as a plate-like leaf spring. This results in a synchronous mechanism of particularly flat design, since the leaf spring can be arranged in the unloaded state in contact with the seat surface support or at a slight distance (e.g. due to a slight preload in certain areas at a slight distance) of 1 to a maximum of 5, in particular 3 cm. In this case—as described above—the leaf spring can have several separate sections offset in and/or transversely to the sagittal direction. In addition, the leaf spring can also have more than one spring plate in the thickness direction, in particular to vary its spring stiffness (either overall or relative to the individual sections).

In an assembly-technically advantageous embodiment, the lever section of the pivot lever is in unattached contact with the seat surface support at the bearing point. In particular, the lever section in this embodiment lies freely against the seat surface support.

In a preferred further development, the lever section of the swivel lever is arranged so that it can be moved relative to the seat surface support while changing its lever length. Consequently, the bearing point (i.e., specifically, the contact point between the pivot lever and the seat surface support) can shift relative to the pivot point. In this case, in particular the lever arm (i.e. the lever length)—i.e. the distance from the bearing point to the pivot point—increases due to the displacement of the bearing point with increasing backward inclination of the backrest, which in turn increases the resistance force against further backward inclination. Since the weight force of the user of the seat also counteracts the backward inclination via the lever arm (which increases with backward inclination), the automatic weight control is advantageously supported, in particular by implementing a weight-dependent increase in resistance with increasing backward inclination.

In an appropriate further development, the free end of the lever arm (which can be moved relative to the seat support) is rounded. Due to the rotation of the free end (when the backrest is tilted backwards) around the pivot point, the free end not only slides in a straight line on the seat surface support, but in particular rolls on the latter. The rounded shape of the free end advantageously supports this rolling of the lever arm on the seat support, and optionally also reduces or prevents any abrasive sliding.

Preferably, the lever section of the pivot lever is its free end. In this case, the backrest support engages in particular in an L-shaped manner from the rear side (e.g. from the rear edge) under the seat surface, is then—seen from a spatial point of view—coupled first at the pivot point with the bending spring and is then in contact with the seat surface support with its free end.

In an alternative variant, the lever section is formed by a section located between a backrest connection of the backrest support and the pivot point. In this case, the backrest is connected to the pivot lever via a connecting piece (the backrest connection) in the intended final assembled state. In this case, the connecting piece runs from the rear side first in the direction of the front edge and is then angled back to the pivot point via the bearing point. In this case, the backrest connection is designed in particular as an armrest.

In an appropriate embodiment of the invention, the bending spring is positively and displaceably supported at a front and/or a rear edge region of the seat surface support parallel to the sagittal direction. The positive and displaceable coupling is formed in this case by a type of thrust bearing, in particular in the form of a notch or groove, which is open in the direction of the seat surface center and into which the bending spring (in particular the leaf spring) is inserted at the end. Since the bending spring is braced against the seat surface support and thus deformed when the backrest is loaded and tilted backwards, there is a regular change in length, in this case in particular a shortening of the bending spring (seen in projection on a horizontal line). In the loaded state, the displaceable bearing advantageously allows a length compensation when the bending spring is bent.

In an additional or alternative (but also appropriate) embodiment, the bending spring is coupled to the seat surface support at the front and/or rear edge region of the seat surface support by means of a pivot bearing. The term "pivot bearing" here and in the following is understood to mean in particular a bearing, which is arranged in a fixed position relative to the component supporting it, and which releases only a degree of rotational freedom. In continuation of the embodiment as described above, the rear end of the bending spring, for example, is held by means of such a pivot bearing on the seat support (thus stationary relative to the latter), whereas the front end of the bending spring is additionally also accommodated with a thrust degree of freedom in the sagittal direction in a corresponding notch (also: "groove") of the seat support—or correspondingly vice versa. Preferably, the pivot bearing in this case is formed by a bearing pin or bolt penetrating the bending spring, in particular the leaf spring transverse to the plane of the leaf spring, which is likewise anchored in the seat surface support. In a variant to this, the end mounted with thrust degree of freedom is supported by means of a "rotary sliding bearing". In particular, the above-mentioned bearing pin is accommodated in an elongated hole in the bending spring or the seat support, so that the bearing pin can be moved along the elongated hole, which is aligned in particular in the sagittal direction.

In an appropriate embodiment of the invention, the bending spring is coupled to the seat surface support at the front and also at the rear edge region of the seat surface support by means of a pivot bearing. Thus, the bending spring is fixedly coupled to the seat surface support at both ends in the sagittal direction, i.e. it cannot be displaced. The lever section of the pivot lever is expediently coupled to the seat surface support at the bearing point by means of a pivot bearing. Thus, the lever section is also coupled to the seat surface support, specifically to the force application point in the seat surface support, so that it cannot be displaced in the sagittal direction. In this embodiment, the increasing resistance force ("resistance progression") with increasing backward inclination of the backrest is caused by the bending spring itself, in particular by its (increasing) tension in the sagittal direction against the fixed ends of the bending spring and/or of the lever section between the pivot point and the bearing point, because displacement of the bearing point relative to the pivot point is prevented in this case.

In a further appropriate embodiment, the bending spring and the seat surface support are formed integrally, in particular monolithically, with each another. The component section, which acts as a spring and is assigned to the "actual" bending spring, is formed by a number of slots in legs of a leaf spring, which are designed to be movable relative to one another. Preferably, two mutually open and U-shaped slots are inserted in the common component in the front and rear edge area of the seat surface support. Within these U-shaped slots, two slots running parallel to the sagittal direction are arranged, which (together with the standing legs of the "Us" of the first two slots) cut three parallel spring legs free from the common component. In this case, the "actual" bending spring is not directly connected with its front and rear ends to the seat surface support, but its middle leg is connected at the end to the seat surface support area of the common component via the two outer legs, which pass laterally into the seat surface support area. In this variant, a pivot bearing is optionally arranged at the bearing point in addition to the pivot point. This further simplifies the manufacture and assembly of the synchronous mechanism, as the seat surface support and bending spring form an integral component.

In a preferred embodiment of the invention, the leaf spring—and, in further development of the "integrated" design described above, also the seat support—is formed by fiber-reinforced plastic, in particular a glass- or carbon-fiber-reinforced polyamide. Preferably, the leaf spring is injection molded in this case.

In addition to the synchronous mechanism described above, the seating furniture according to the invention preferably also comprises the backrest, in particular the seat surface and the frame, which are connected to the backrest support. Consequently, the seating furniture also has the features described above in connection with the synchronous mechanism and the advantages resulting therefrom.

Figure 2:
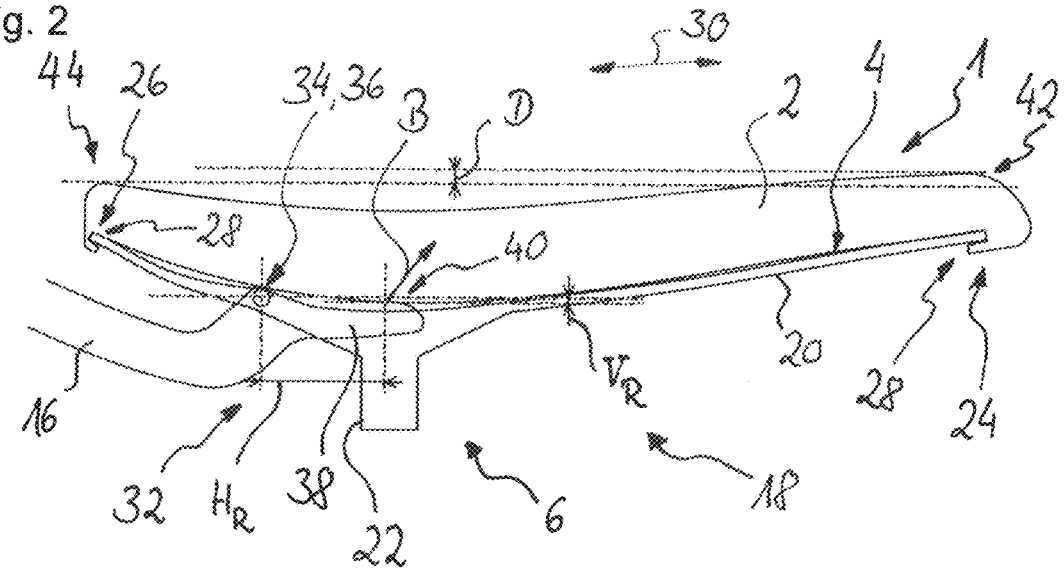
Figure 3:
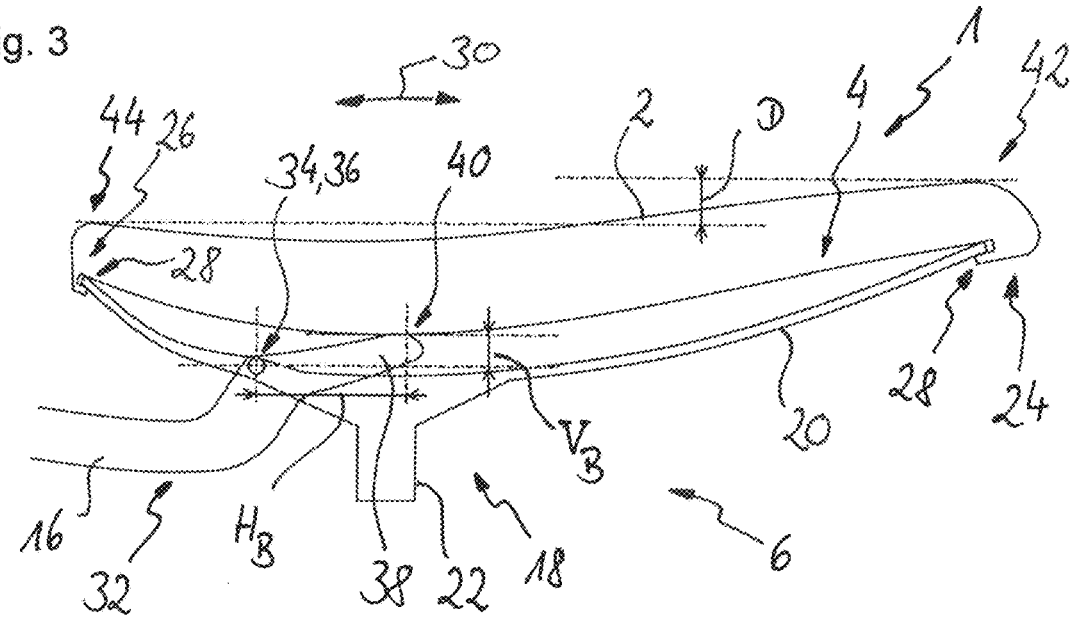
Figure 4:
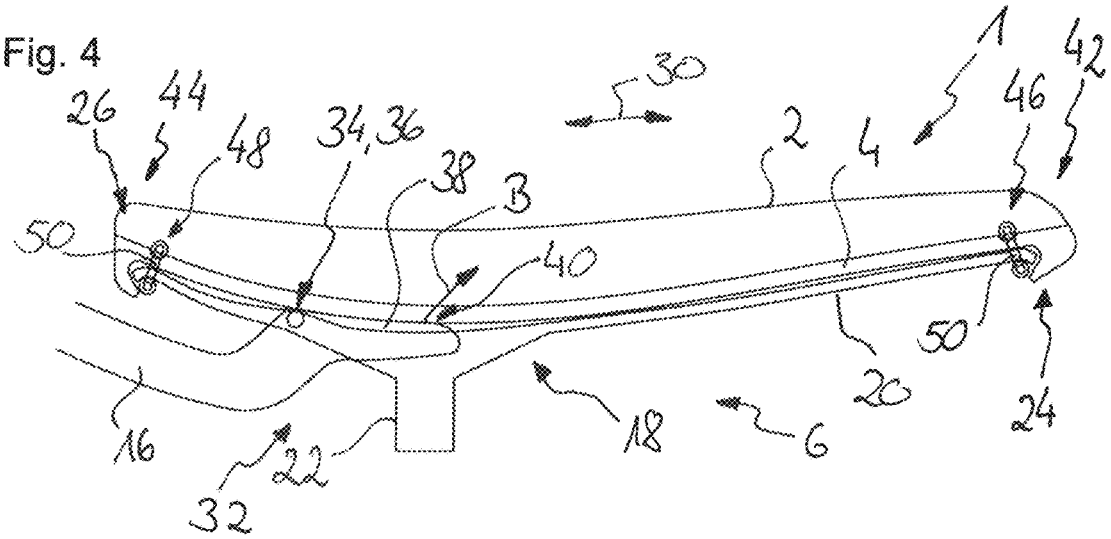
Figure 5:
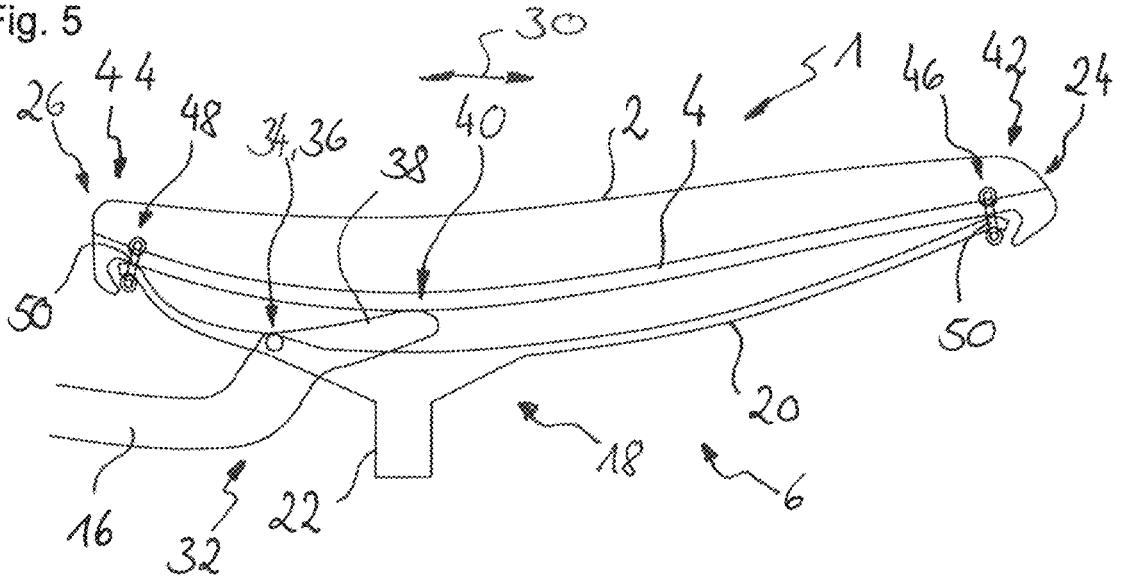
Figure 6:
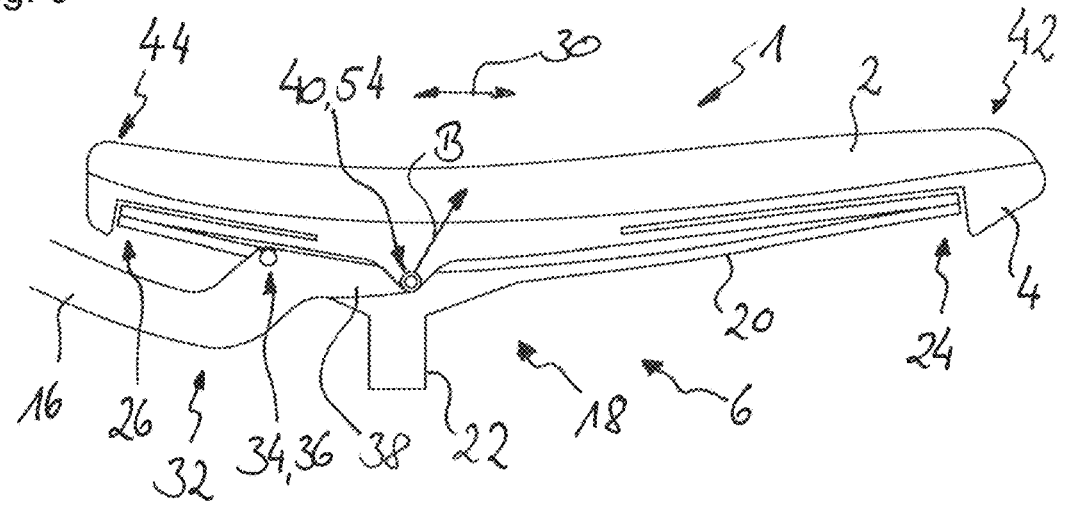
Figure 7:
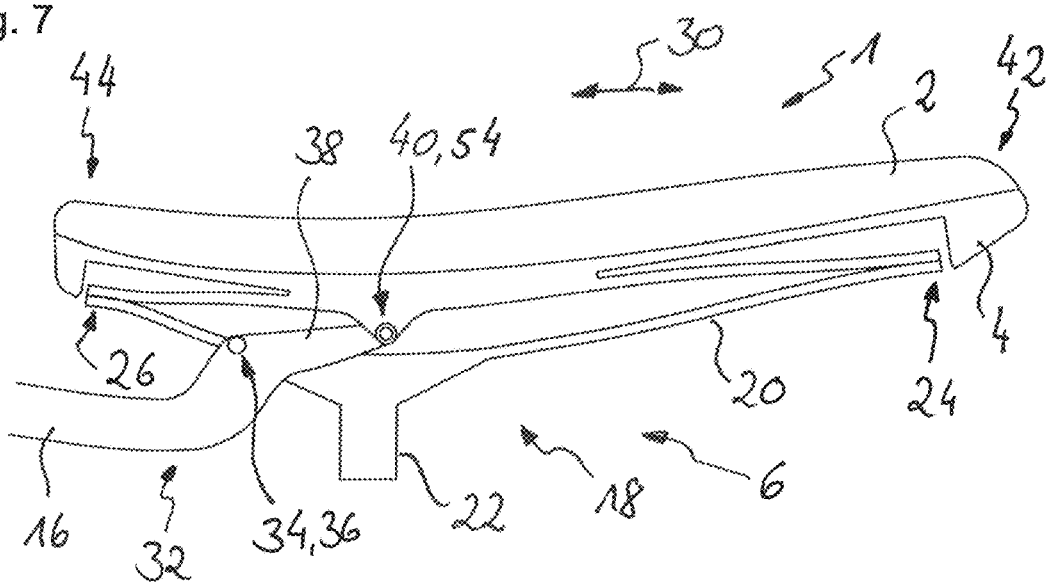
Figure 8:
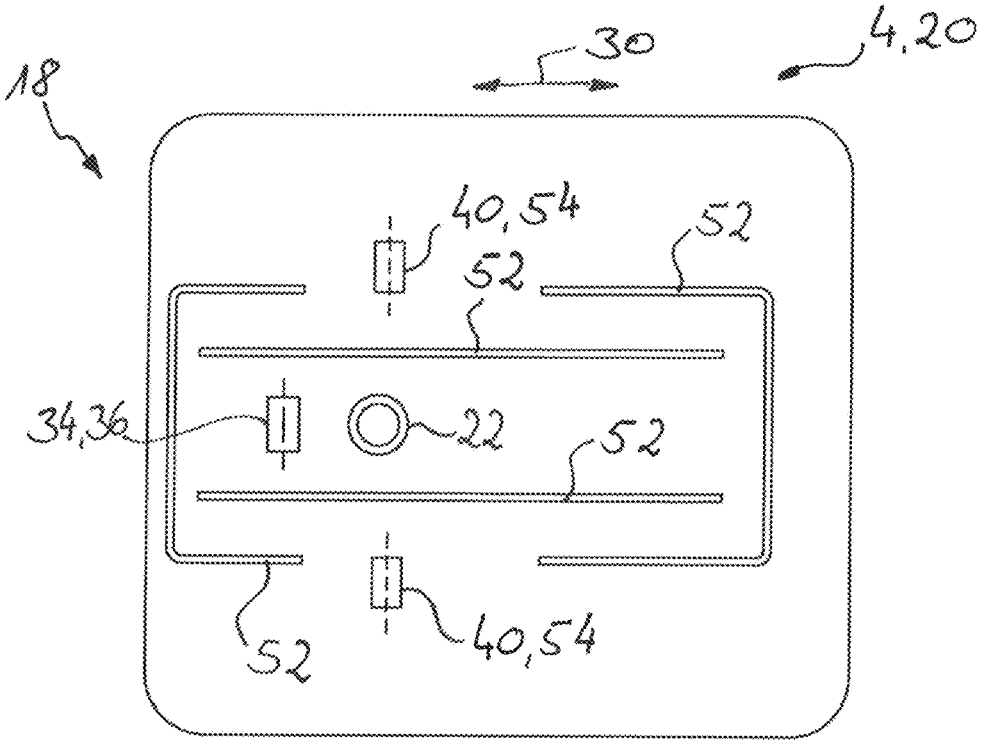
Figure 9:
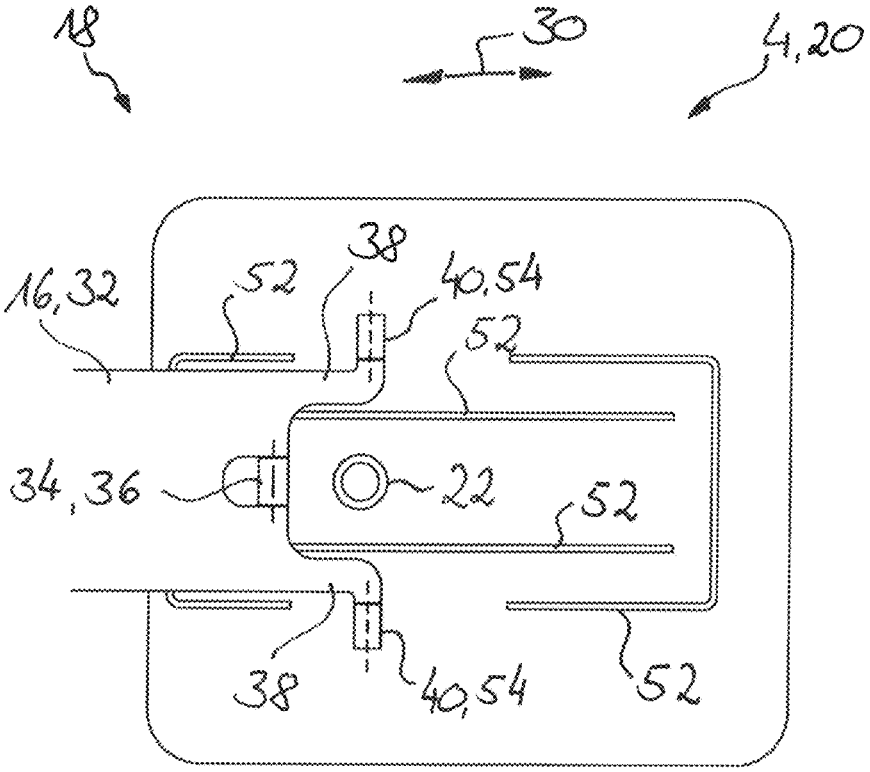
Figure 10:
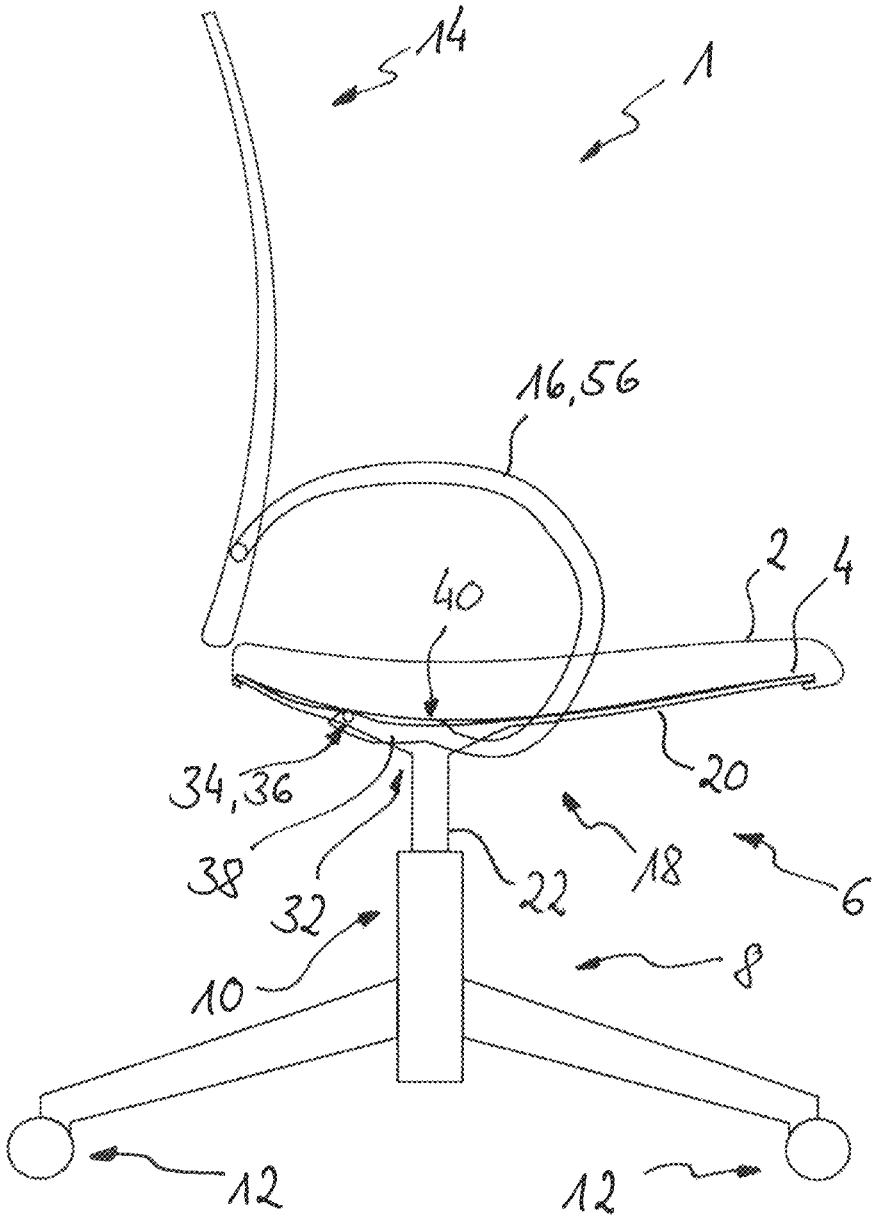

In the following, embodiment examples of the invention are explained in more detail with reference to a drawing. Therein the figures show:

FIG. 1 in a schematic side view a piece of seating furniture, in particular an office swivel chair, FIG. 2 in a view according to FIG. 1, a cut-out detailed view of a synchronous mechanism of the seating furniture in a resting position, FIG. 3 in a view according to FIG. 2, the synchronous mechanism in a loaded position, FIGS. 4, 5 in a view according to FIGS. 2 and 3 respectively, a further embodiment example of the synchronous mechanism, FIGS. 6, 7 in a view according to FIGS. 2 and 3 respectively, again a further embodiment example of the synchronous mechanism, and FIGS. 8, 9 in a view of a lower side, the synchronous mechanism in different detailed views, and FIG. 10 in a view according to FIG. 1, an alternative design example of the seating furniture.

Corresponding parts (and measures) are always provided with the same reference signs in all figures.

In FIG. 1, a piece of seating furniture, specifically an office swivel chair, briefly referred to as "office chair 1", is shown schematically. The office chair 1 has a seat surface 2 formed by a seat cushion, which is attached to a seat surface support 4. Furthermore, the office chair 1 has a seat support 6, which connects the seat surface support 4 to a frame, specifically a pedestal 8. Interposed between the seat support 6 and the pedestal 8 is a gas spring 10 for adjusting the height of the seat surface 2. In addition, the pedestal 8 carries a plurality of casters 12. The office chair 1 also has a backrest 14, which is supported on a backrest support 16 and arranged by means of the latter to be movable relative to the pedestal 8 and the seat surface 2.

The backrest support 16, the seat support 6 and the seat surface support 4 together form a synchronous mechanism 18. By means of the synchronous mechanism 18, the seat surface 2 is raised when the backrest 14 is tilted back.

The seat support 6 has a bending spring as a bending element, which is specifically formed by a leaf spring 20, and a receptacle 22 for the pedestal 8, specifically for the gas spring 10. The receptacle 22 and the leaf spring 20 are injection-molded as an integral component from fiber-reinforced polyamide. The leaf spring 20 is received with its front end 24 (relative to the backrest 14) and its rear end 26, respectively, in a thrust bearing 28 of the seat surface support 4. Each thrust bearing 28 is formed by a groove, which is open in the sagittal direction 30 and towards the center of the seat surface 2. The backrest support 16 has a pivot lever 32 at its end facing away from the backrest 14 (see FIG. 2). Seen from the backrest 16, this lever is initially attached to the leaf spring 20 at a pivot point 34 by means of a pivot bearing 36, which is fixedly arranged to the leaf spring 20. The pivot lever 32 in this connection is pivotable about an axis of rotation lying in the horizontal and transverse to the sagittal direction. With a lever section 38, which in the present embodiment is designed on the free-end side of the pivot lever 32, the latter rests freely on a bearing point 40 on the seat surface support 4. The pivot point 34 and the bearing point 40 are arranged in a rear half of the leaf spring 20 as viewed in the sagittal direction 30.

In the unloaded state ("resting state") of the backrest 14, the bearing point 40 is arranged offset by an offset $V_R$ below the pivot point 34 and offset by a lever arm $H_R$ in the sagittal direction 30 to the front end 24 of the leaf spring 20. As a result, when the backrest 14 is loaded and thus tilted backward (see FIG. 3), the bearing point 40 moves upward in an approximately straight line. Specifically, however, at the beginning of a movement (i.e., still in the resting position), a movement vector B represented by a tangent to the radius spanned by the lever section 38 is slightly inclined from the horizontal towards the front end 24 of the leaf spring 20 (shown overdrawn in FIG. 2). As a result, under load, the distance between the bearing point 40 and the pivot point 34 increases slightly to form an elongated lever arm $H_B$. This in turn results in increased resistance to further backward tilting of the backrest 14.

Since the movement of the lever section 38, specifically its free end, is not in a straight line but along a circular path (having the radius of the length of the lever section 38), the free end of the lever section 38 rolls on the seat surface support 4. To support this rolling motion, the free end is rounded.

Under load, the offset $V_R$ thus also changes to an offset $V_B$ in the loaded state, in which the bearing point 40 is arranged above the pivot point 34.

Specifically, the leaf spring 20 is braced against the seat surface support 4 under elastic deformation (see FIG. 3) and thus the seat surface 2 is raised. In addition, a height difference D between a front edge 42 and a rear edge 44 of the seat surface 2 is changed in the process.

In this connection, the thrust bearing 28 enables a change in length of the leaf spring 20 during its elastic deformation.

FIGS. 4 and 5 show an alternative embodiment example. Instead of the thrust bea-ring 28, the respective ends 24 and 26 of the leaf spring 20 are fixed by means of a rotary thrust bearing 46 and a pivot bearing 48, respectively. Specifically, in the pivot bearing 48, the leaf spring 20 is fixed by means of a pin 50 so as to be pivotable but stationary relative to the seat surface support 4. At the (front) rotary thrust bearing 46, the pin is engaged in an elongated hole (not shown in more detail) in the leaf spring 20, so that longitudinal displaceability is maintained.

In another alternative embodiment example, also explained with reference to FIGS. 4 and 5, the front rotary thrust bearing 46 is replaced by another pivot bearing in the manner of pivoty bearing 48. Thus, the two ends 24 and 26 are fixedly, i.e. non-displaceably and only pivotally, supported on the seat surface support 4.

FIGS. 6 to 9 show another alternative embodiment example. In this case, the seat surface support 4 and the leaf spring 20 are designed in one piece as an integral injection molded part. In this case, the leaf spring 20 is multi-legged and cut out of the base body common to the seat surface support 4 through several slots 52 (see FIGS. 8, 9) in a spring-acting manner. The pivot lever 32, specifically the lever section 38, is arranged in a pivot bearing 54 (a pivot bearing 54 on each of both transverse sides of the lever section 38) and thus non-displaceably on the seat surface support 4. As a result, under load and thus actually increasing (horizontal) distance between the pivot point 34 and the bearing point 40, the leaf spring 20 is tensioned in the sagittal direction In an alternative embodiment example to FIGS. 6 to 9 (not shown in more detail), the lever section 38 is freely applied to the seat surface support 4 at the bearing point 40, omitting the pivot bearing 54.

FIG. 10 shows another embodiment example of the office chair 1. In this case, an armrest 56 is formed by the backrest support 16. In this case, the lever section 38 is located between the pivot point 34 and the bearing point 40, the pivot point 34 being arranged at the end of the pivot lever 32 or the backrest support 16.

The object of the invention is not limited to the embodiment examples as described above. Rather, further embodiments of the invention may be derived by the expert from the foregoing description. In particular, the individual features of the invention described by means of the various embodiment examples and the embodiment variants thereof can also be combined with each another in other ways.

LIST OF REFERENCE SIGNS

1 office chair
2 seat surface
4 seat surface support
6 seat support
8 pedestal
10 gas spring
12 caster
14 backrest
16 backrest support
18 synchronous mechanism
20 leaf spring
22 receptacle
24 front end
26 rear end
28 thrust bearing

30 sagittal direction
32 pivot lever
34 pivot point
36 pivot bearing
38 lever section
40 bearing point
10 42 front edge
44 rear edge
46 rotary thrust bearing
48 pivot bearing
50 pin
18 52 slot
54 pivot bearing
56 armrest
$V_R$, $V_B$ offset
$H_R$, $H_B$ lever arm
D height difference
B movement vector

What is claimed is:

1. A synchronous mechanism (18) for a seating furniture (1), for a chair, with a seat surface support (4) for supporting a seat surface (2) in an intended final assembly state of the seating furniture (1), with a bending element (20), the length of which extends in sagittal direction (30) over a major part of a seat depth of the seat surface support (4), and which is movably coupled to the seat surface support (4) with respect thereto, with a backrest support (16) for supporting a backrest (14), said backrest support being mounted movably relative to the bending element (20), wherein the backrest support (16) merges at an end into a pivot lever (32) which is coupled to the bending element (20) at a pivot point (34) so as to be pivotable about an axis of rotation transverse to the sagittal plane, wherein a lever section (38) of the pivot lever (32) is in contact with the seat surface support (4) at a bearing point (40), and wherein, an unloaded state of the seat furniture (1), the pivot point (34) lies higher than the bearing point (40) when viewed in the height direction.

2. The synchronous mechanism (18) according to claim 1, wherein the bending element (20) has a receptacle for a frame (8) of the seating furniture (1).

3. The synchronous mechanism (18) according to claim 1, wherein in the unloaded state the bearing point (40) is arranged such that a movement vector (B) is aligned parallel to a vertical axis or inclined at an acute angle away from the vertical axis and the pivot point (34).

4. The synchronous mechanism (18) according to claim 1, wherein the bending element (20) is divided by the pivot point (34) and/or the bearing point (40) into a short spring arm facing a rear side of the seat surface support (4) and into a long spring arm elongated in comparison to the short spring arm and facing a front side.

5. The synchronous mechanism (18) according to claim 1, wherein the bending element is designed as a leaf spring (20).

6. The synchronous mechanism (18) according to claim 1, wherein the lever section (38) of the pivot lever (32) is in unattached contact with the seat surface support (4) at the bearing point (40).

7. The synchronous mechanism (18) according to claim 6, wherein the lever portion (38) of the pivot lever (32) is arranged to be displaceable relative to the seat surface support (4) while varying a lever length.

8. The synchronous mechanism (18) according to claim 1, wherein the bending element (20) is form-lockingly held on at least one of a front and a rear edge region (42, 44) of the seat surface support (4) so as to be displaceable parallel to the sagittal direction (30).

9. The synchronous mechanism (18) according to claim 1, wherein the bending element (20) is coupled to the seat surface support (4) at at least one of a front and a rear edge region (42, 44) of the seat surface support (4) by means of a corresponding pivot bearing (46, 48).

10. The synchronous mechanism (18) according to claim 9, wherein the bending member (20) is coupled to the seat surface support (4) at both the front and rear edge regions (42, 44) of the seat surface support (4) by means of the corresponding pivot bearing (46, 48), and wherein the lever portion (38) of the pivot lever (32) is coupled to the scat surface support (4) at the bearing point (40) by means of a pivot bearing (54).

11. The synchronous mechanism (18) according to claim 1, wherein the bending element (20) and the seat surface support (4) are formed in a one piece formation as legs of a leaf spring (20) which are formed by slots (52), wherein the legs are movable relative to one another.

12. The synchronous mechanism (18) according to claim 11, wherein the bending element (20) and the seat surface support (4) are formed monolithically.

13. The synchronous mechanism (18) according to claim 1, wherein the bending element is a leaf spring (20) formed by of a fiber-reinforced polyamide plastic composition.

14. A seating furniture (1) with a synchronous mechanism (18) according to claim 1.

* * * * *